US009822663B2

(12) United States Patent
Evans

(10) Patent No.: US 9,822,663 B2
(45) Date of Patent: Nov. 21, 2017

(54) FAN CASING FOR A GAS TURBINE ENGINE

(71) Applicant: ROLLS-ROYCE PLC, London (GB)

(72) Inventor: Dale Edward Evans, Derby (GB)

(73) Assignee: ROLLS-ROYCE plc, London (GB)

( * ) Notice: Subject to any disclaimer, the term of this patent is extended or adjusted under 35 U.S.C. 154(b) by 341 days.

(21) Appl. No.: 14/596,664

(22) Filed: Jan. 14, 2015

(65) Prior Publication Data

US 2015/0218964 A1 Aug. 6, 2015

(30) Foreign Application Priority Data

Feb. 5, 2014 (GB) ..... 1401932.7

(51) Int. Cl.

| | |
|---|---|
| ***F01D 25/14*** | (2006.01) |
| ***F01D 25/24*** | (2006.01) |
| ***F01D 25/00*** | (2006.01) |
| *F04D 29/02* | (2006.01) |
| *F04D 29/54* | (2006.01) |

(52) U.S. Cl.

CPC ..... *F01D 25/145* (2013.01); *F01D 25/005* (2013.01); *F01D 25/243* (2013.01); *F04D 29/023* (2013.01); *F04D 29/545* (2013.01); *F05D 2300/174* (2013.01); *F05D 2300/21* (2013.01); *F05D 2300/43* (2013.01); *F05D 2300/502* (2013.01); *F05D 2300/603* (2013.01); *F05D 2300/702* (2013.01)

(58) Field of Classification Search

CPC .... F01D 25/145; F01D 25/005; F01D 25/243; F05D 2300/174; F05D 2300/21; F05D 2300/43; F05D 2300/502; F05D 2300/603; F05D 2300/702

USPC ..... 415/200, 9

See application file for complete search history.

(56) References Cited

U.S. PATENT DOCUMENTS

| | | | | |
|---|---|---|---|---|
| 4,534,698 | A | 8/1985 | Tomich | |
| 4,902,201 | A | 2/1990 | Neubert | |
| 5,431,532 | A | 7/1995 | Humke et al. | |
| 7,780,420 | B1 * | 8/2010 | Matheny | F01D 5/14 416/241 R |
| 2009/0010755 | A1 | 1/2009 | Keller et al. | |
| 2012/0082541 | A1 * | 4/2012 | Macchia | F01D 21/045 415/200 |

(Continued)

FOREIGN PATENT DOCUMENTS

| | | |
|---|---|---|
| EP | 2 474 712 A2 | 7/2012 |
| EP | 2 620 652 A1 | 7/2013 |

(Continued)

OTHER PUBLICATIONS

Jun. 1, 2015 Search Report issued in European Application No. 15 15 0885.

(Continued)

*Primary Examiner* — Richard Edgar
(74) *Attorney, Agent, or Firm* — Oliff PLC

(57) ABSTRACT

The present invention relates to a fire resistant fan casing for a gas turbine engine. The casing has a projection such as a reinforcing rib or a mounting pad. The projection comprises at least one shell portion formed of a fiber/plastic composite material encasing a core of fire resistant material such as a metallic material or a ceramic matrix composite material.

9 Claims, 5 Drawing Sheets

(56) References Cited

U.S. PATENT DOCUMENTS

2013/0202449 A1* 8/2013 Lombard ..... F01D 5/02
416/244 R

FOREIGN PATENT DOCUMENTS

GB 2442112 A 3/2008
WO 2012/065155 A1 5/2012

OTHER PUBLICATIONS

Sep. 25, 2014 Search Report in British Patente Application No. 1401932.7.

* cited by examiner

FAN CASING FOR A GAS TURBINE ENGINE

FIELD OF THE INVENTION

The present invention relates to a fan casing for a gas turbine engine. In particular, the present invention relates to a fire resistant fan casing having a projection such as a reinforcing rib or a mounting pad.

BACKGROUND OF THE INVENTION

Gas turbine engines are typically surrounded by a fan casing which may be formed of a composite material comprising carbon fibres and a plastic material, e.g. bismaleimide (BMI) resin. To provide structural rigidity to the fan casing, an annular reinforcing rib is provided.

Such fan casings can be required to be fire resistant and it has been found that fan casings having a reinforcing rib formed of a carbon fibre/BMI resin composite tend to fail the industry requirements for fire resistance—it has been observed that significant flame is sustained by the composite reinforcing rib after removal of the heat source and this is unacceptable. It is thought that this is a result of the thickness of the reinforcing rib leading to a pool of resin that is too great to be burned-off during the fire resistance tests.

The annular reinforcing rib has a thickness that varies circumferentially. Attempts to replace the thicker portions of the composite reinforcing rib with metal (e.g. titanium) portions bolted to the composite reinforcing rib has been found to lead to an undesirable increase in fan casing weight, cost and part count.

The inventors have found that reducing the thickness of the thicker portions of the composite reinforcing rib and reinforcing them with laterally opposed metal (e.g. titanium) plates bolted to one another through the rib is unsuccessful—it is thought that the metal plates shield the composite reinforcing rib from the flame but act as a heat sink to sustain resin ignition as it melts and moves to the surface of the reinforcing rib through the bolt holes.

Mounting pads are also provided on fan casings for mounting/supporting accessories from the fan casing. These pads (also known as "pad up patches") typically comprise thickened portions of the fan casing and, again, these thickened portions can result in a reservoir of resin that is too great to be burned off during the fire resistance test.

There is the need to provide a fan casing having a projection which meets the industry standards for fire resistance but which also has an acceptable weight and cost and is ideally integral to the fan case for a low part count.

SUMMARY OF THE INVENTION

In a first aspect, the present invention provides a casing having a projection, wherein the projection comprises at least one shell portion formed of fibre/plastic composite material encasing a core of fire resistant material.

By replacing the thickened portions of the projection with a composite shell portion containing a fire resistant core, the structural strength of the projection can be maintained but the pool of flammable resin is reduced thus avoiding continued burn of the projection after removal of the heat source during tests i.e. thus improving fire resistance of the casing.

Optional features of the invention will now be set out. These are applicable singly or in any combination with any aspect of the invention.

In some embodiments, the projection is a reinforcing rib.

In some embodiments, the projection is a mounting pad.

In some embodiments, the casing (e.g. a casing for a gas turbine engine) comprises an annular (e.g. cylindrical or conical) casing with the projection extending radially from and at least partly circumscribing the annular casing. The projection may be an annular projection circumscribing the annular casing.

In some embodiments, the projection may comprise a plurality of shell portions each containing a respective core (e.g. annularly spaced shell portions each circumscribing a portion of the annular casing). In some embodiments, the projection may comprise a single shell portion circumscribing the annular casing.

The core is selected such that it maintains its structural integrity at high temperatures, does not thermally decompose to generate flammable fluids and has a similar coefficient of thermal expansion to the shell portion over normal operating temperatures (to avoid excessive interface stresses). In some embodiments, it is selected to contribute to the stiffening function of the rib. In some embodiments, it is selected to be lightweight.

The fire resistant core may be a metallic (e.g. titanium or a titanium alloy) core, a metallic matrix composite (MMC) core, a ceramic core or a ceramic matrix composite (CMC) core. It may comprise fibres e.g. carbon fibres or silicon carbide fibres. The core helps strengthen and/or stiffen the projection without the need for interface fasteners since the core is constrained/enclosed within the respective shell portion.

A suitable metallic matrix core comprises fibres (e.g. silicon carbide fibres) coated in metal (e.g. titanium, cobalt or cobalt-nickel) by spray or vapour deposition subsequently combined using known solid state joining methods such as diffusion bonding, heat and/or pressure to form the core. A suitable ceramic matrix composite (CMC) core may comprise carbon fibres in a silicon carbide matrix.

The/each core can have any cross-sectional profile but may have a circular, rectangular, square, wedge-shaped or T-shaped cross-sectional profile. The cross-sectional area of the core may vary circumferentially.

In some embodiments, the or each core is solid. In some embodiments it may be a meshed, ribbed or foamed structure and/or it may contain recesses and/or channels/grooves. For example, the core may be formed of a foamed metal e.g. foamed titanium. The core may be machined to form surface grooves, channels or recesses. A meshed, ribbed or foamed structure reduces weight whilst recesses/channels/grooves help intimate binding to the shell portion e.g. using resin transfer molding.

The fibre/plastic composite material forming the shell portion may comprise fibres of carbon, glass, aramid or boron. The fibres may form a laminated or woven fibrous network. The fibre/plastic composite material may comprise a bismaleimide (BMI), epoxy or polyimide resin.

The thickness of the shell portion may be around or less than 6 mm such that rapid burn-off of the resin may occur.

To form the projection, the fibrous network forming the shell portion may be formed around the fire resistant core and placed in a mould. Using the known resin transfer moulding (RTM) process, resin is introduced into the mould under high pressure and the resin infuses and keys with the fibrous network and with the fire resistant core (especially if the core is meshed, ribbed or foamed or has surface recesses/channels/grooves).

The casing (e.g. annular casing) may also be formed of the fibre/plastic composite material.

In some embodiments, the projection may be integral with the casing e.g. by integrating the fibrous network of the projection with the fibrous network of the casing.

In some embodiments the projection e.g., the reinforcing rib comprises a spacer portion spacing the shell portion from the casing. The spacer portion allows for connection (e.g. via a bolt) to an adjacent casing or mating ring where the rib is located at an end of the casing adjacent a flange connection of an adjacent casing or mating ring.

In a second aspect, the present invention provides a gas turbine engine having a casing according to the first aspect.

BRIEF DESCRIPTION OF THE DRAWINGS

Embodiments of the invention will now be described by way of example with reference to the accompanying drawings in which.

DETAILED DESCRIPTION AND FURTHER OPTIONAL FEATURES OF THE INVENTION

Figure 1:
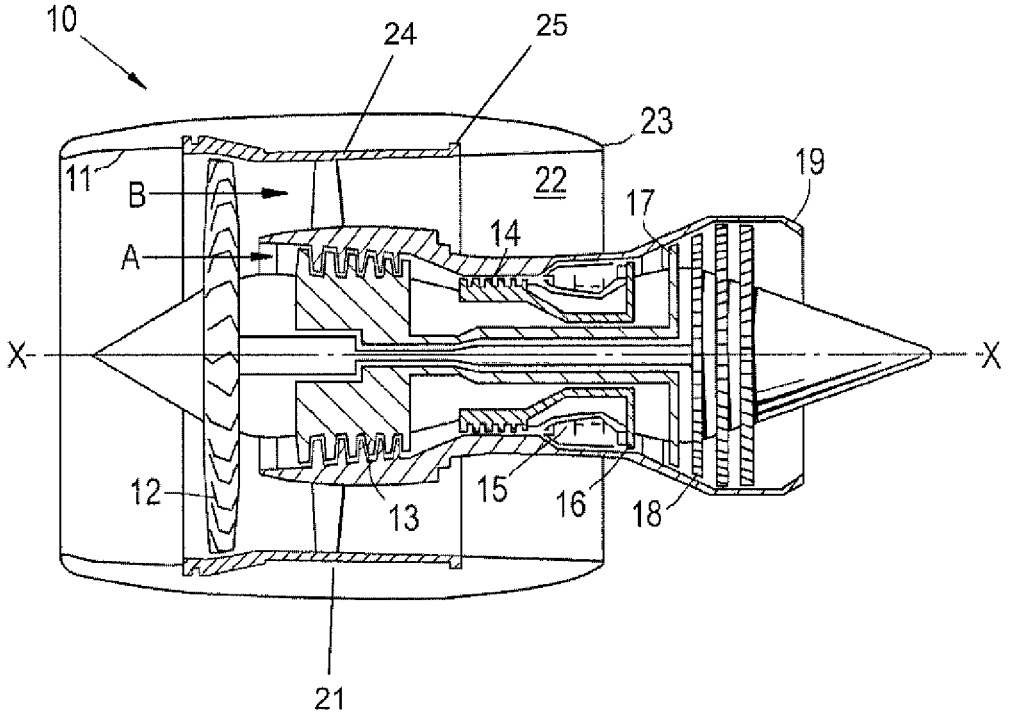
FIG. 1 shows a cross section through a ducted fan gas turbine engine incorporating the invention.

With reference to FIG. 1, a ducted fan gas turbine engine incorporating the invention is generally indicated at 10 and has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

During operation, air entering the intake 11 is accelerated by the fan 12 to produce two air flows: a first air flow A into the intermediate pressure compressor 13 and a second air flow B which passes through the bypass duct 22 to provide propulsive thrust. The intermediate pressure compressor 13 compresses the air flow A directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate pressure compressors 14, 13 and the fan 12 by suitable interconnecting shafts.

The engine is surrounded by an annular fan case 24 formed of carbon fibre-reinforced bismaleimide resin. A projection 25 is provided extending radially outwardly from the annular fan case 24.

Figure 2:
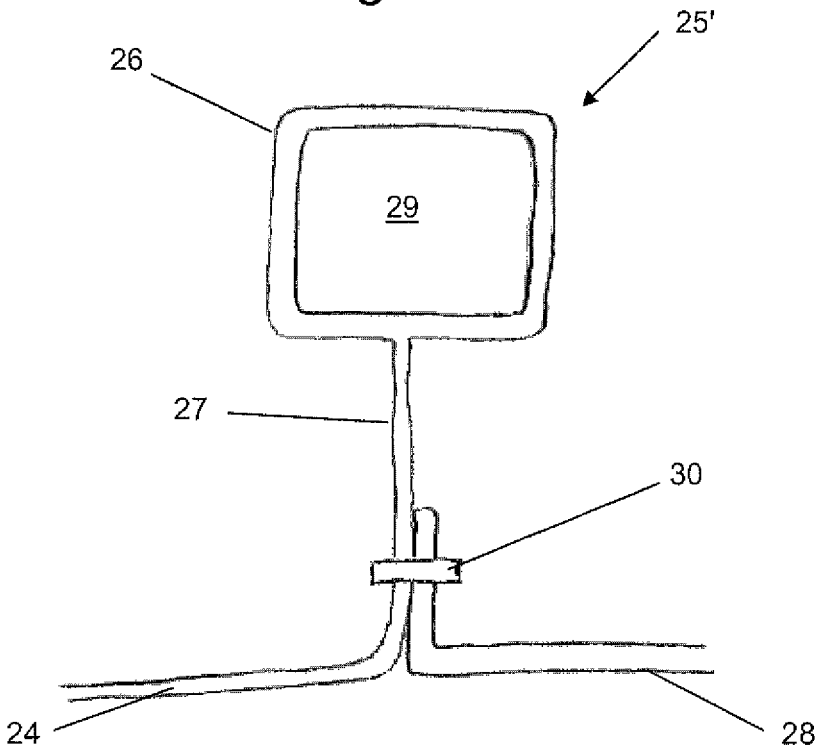
FIG. 2 shows an axial cross section through a first embodiment of the invention.
Figure 3:
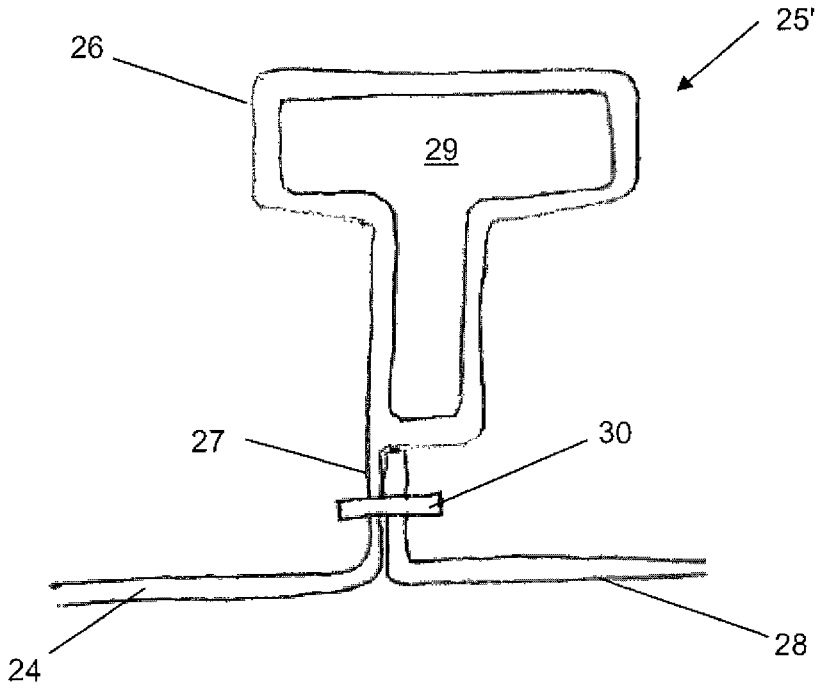
FIG. 3 shows an axial cross section through a third embodiment of the present invention.
Figure 4:
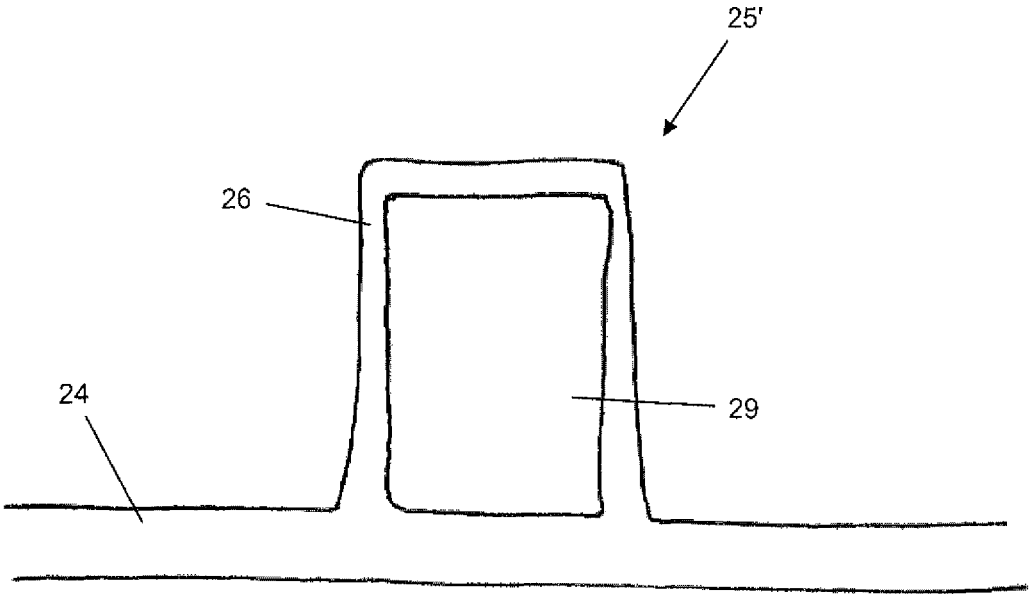
FIGS. 4 and 4*b* show axial cross sections through a fourth embodiment of the invention.
Figure 5:
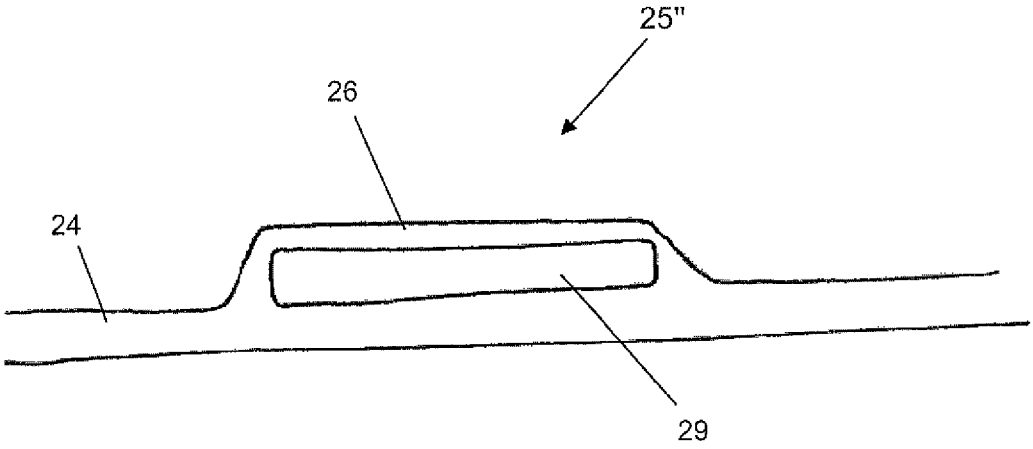
FIG. 5 shows an axial cross section through a fifth embodiment of the present invention.
Figure 5B:
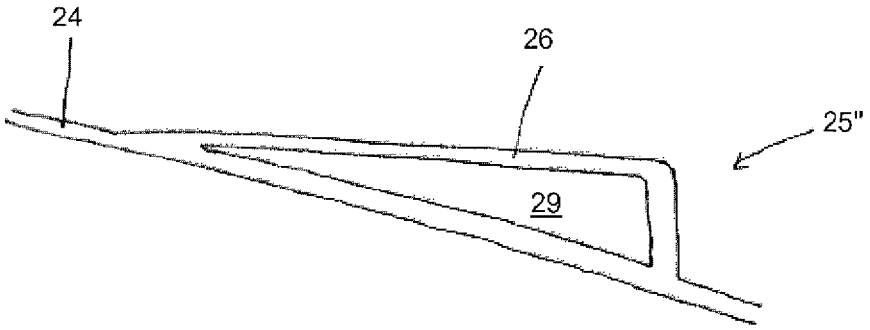
FIG. 5*b* shows an axial cross-section through a sixth embodiment of the present invention.

Further detail of the annular projection 25 is shown in the remaining Figures. FIGS. 2 to 4 show an annular reinforcing rib which circumscribes the fan casing 24 whilst FIGS. 5 and 5*b* show a mounting pad.

As shown in FIGS. 2 to 4, the reinforcing rib 25' comprises a shell portion 26. In the embodiments, shown in FIGS. 2, 2*b* and 3, the shell portion 26 is spaced from the fan casing 24 by a spacer portion 27. The spacer portion 27 is connected to an adjacent titanium mating ring 28 through a bolt 30.

Figure 4B:
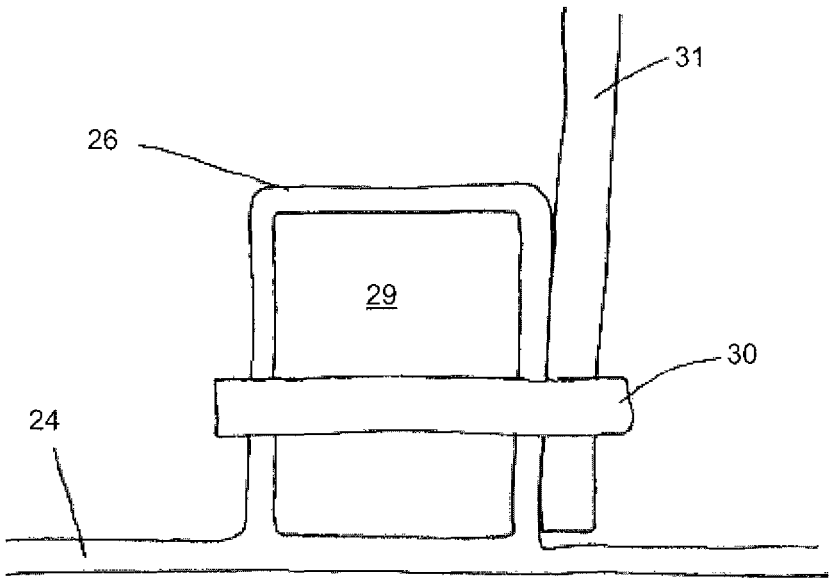

In the embodiment shown in FIG. 4, there is no spacer portion and the shell portion 26 extends to the fan casing 24. In addition to functioning as a reinforcing rib, this embodiment can be used to mount an accessory 31 via an axial bolt 30 through the core 29 (as shown in FIG. 4*b*).

The fan case 24 and shell portion 26 (and spacer portion 27 when present) are all formed of carbon fibre-reinforced bismaleimide resin in this example. The carbon fibres form a woven fibrous network infused with the resin. The fibrous network of the fan case 24 and shell portion 26 (and spacer portion 27 when present) are integrated such that the rib 25' is integral with the fan case 24.

FIGS. 5 and 5*b* shows an embodiment having a mounting pad 25" onto which accessories can be bolted to secure them to the fan casing 24. The mounting pad 25" has a shell portion 26 which is integral with the fan casing 24. In this example, the fan casing 24 and shell portion are formed of carbon fibre-reinforced bismaleimide resin.

In all embodiments, the shell portion 26 encases a core 29 formed of titanium metal. The surface of the titanium core is machined to form grooves to help intimate bonding between the core and the shell portion.

Figure 2B:
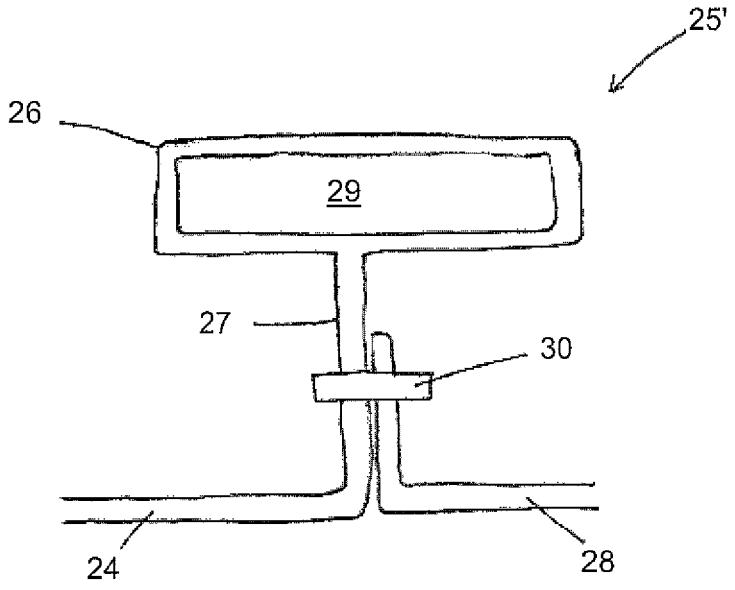
FIG. 2*b* shows an axial cross section through a second embodiment of the invention.

The embodiments shown in FIGS. 2, 2*b* and 3 differ in that, in FIG. 2, the core 29 has a square cross-sectional profile, in FIG. 2*b*, the core 29 has a rectangular cross-sectional profile (with the major axis of the rectangular core axially aligned with the casing), and, in FIG. 3, the core 29 has a T-shaped cross-sectional profile.

The embodiments shown in FIGS. 4 and 5 have a rectangular cross-sectional profile.

The embodiment shown in FIG. 5*b* has a wedge-shaped cross-sectional profile. A wedge-shaped core is useful for maintaining a cylindrical mounting surface on a conical annular casing.

Figure 5C:
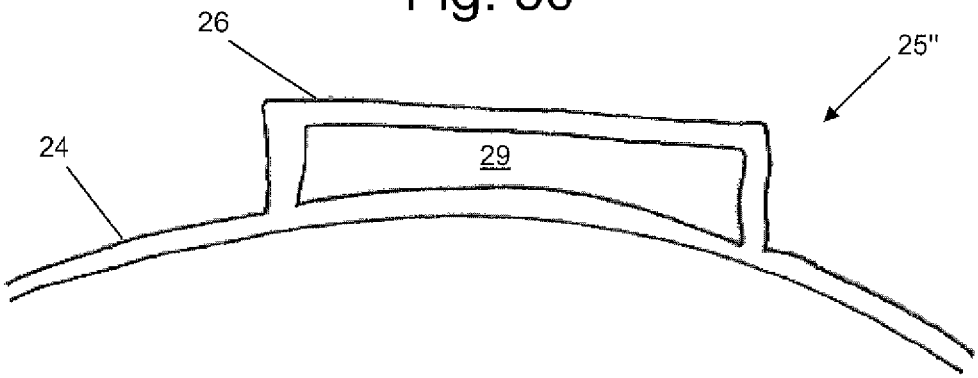
FIG. 5*c* shows a radial cross-section through the fifth and sixth embodiments.

As can be seen from FIG. 5*c*, the radial cross-sectional profile of the core 29 can vary circumferentially for the mounting pad according to the fifth and sixth embodiments.

To form the projection 25, the fibrous network of carbon fibres of the shell portion is formed around the grooved titanium core and placed in a mould. Using the known resin transfer moulding (RTM) process, bismaleimide resin is introduced into the mould under high pressure and the resin infuses and keys with the fibrous network and with grooves on the titanium core.

Although only a single shell portion 26 and core 29 are shown in each of FIGS. 2 to 4, the reinforcing rib 25' comprises a plurality of shell portions/cores circumferentially spaced around the annular rib 25', each shell portion/core circumscribing a portion of the annular casing 24.

The titanium core maintains the structural strength of the reinforcing projection/mounting pad without the need for a large thickness of composite material which leads to prolonged burning during fire resistant tests. The thickness of the composite material in the shell portion is typically less than 6 mm such that rapid burn-off of the resin may occur.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

All references referred to above are hereby incorporated by reference.

The invention claimed is:

1. A gas turbine casing comprising:

a radially-outwardly-extending projection, wherein the radially-outwardly-extending projection comprises at least one shell portion formed of a fibre/plastic composite material encasing a core of fire resistant material so as to maintain structural strength of the projection while improving fire resistance of the gas turbine casing.

2. The gas turbine casing according to claim 1 wherein the casing is an annular casing with the projection at least partly circumscribing the annular casing.

3. The gas turbine casing according to claim 1 wherein the fire resistant core is a metallic, metallic matrix composite, ceramic or a ceramic matrix composite core.

4. The gas turbine casing according to claim 3 wherein the fire resistant core is a titanium core.

5. The gas turbine casing according to claim 1 wherein the fibre/plastic composite material comprises carbon, glass, aramid or boron fibres and a bismaleimide (8MI), polyimide or epoxy resin.

6. The gas turbine casing according to claim 1 wherein the projection comprises a spacer portion spacing the shell portion from the casing.

7. The gas turbine casing according to claim 1 wherein the projection is a reinforcing rib.

8. The gas turbine casing according to claim 1 wherein the projection is a mounting pad.

9. A gas turbine engine comprising the gas turbine casing according to claim 1.

* * * * *